US006558895B2

(12) United States Patent
Uytterhoeven et al.

(10) Patent No.: US 6,558,895 B2
(45) Date of Patent: May 6, 2003

(54) PHOTOTHERMOGRAPHIC RECORDING MATERIALS WITH IMPROVED STABILITY

(75) Inventors: Herman Uytterhoeven, Bonheiden (BE); Luc Vissers, Brecht (BE)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 09/939,941

(22) Filed: Aug. 27, 2001

(65) Prior Publication Data

US 2002/0058219 A1 May 16, 2002

Related U.S. Application Data

(60) Provisional application No. 60/243,990, filed on Oct. 27, 2000.

(30) Foreign Application Priority Data

Sep. 11, 2000 (EP) ..... 00203138

(51) Int. Cl.[7] ..... G03C 1/498; G03C 1/74
(52) U.S. Cl. ..... 430/619; 430/935; 430/964
(58) Field of Search ..... 430/350, 617, 430/964, 619, 935, 620

(56) References Cited

U.S. PATENT DOCUMENTS 5,545,515 A * 8/1996 Murray et al. ..... 430/617
5,705,324 A * 1/1998 Murray ..... 430/350

FOREIGN PATENT DOCUMENTS

| | | |
|---|---|---|
| EP | 0 386 761 A2 | 9/1990 |
| EP | 0 713 133 A1 | 5/1996 |
| EP | 0 775 592 A1 | 5/1997 |
| EP | 0 775 595 A1 | 5/1997 |
| EP | 0 779 539 A1 | 6/1997 |
| EP | 0 810 467 A1 | 12/1997 |
| EP | 0 924 097 A1 | 6/1999 |
| EP | 0 964 300 A1 | 12/1999 |

OTHER PUBLICATIONS

U.S. patent application Ser. No. 09/934,806, Uytterhoeven et al., filed Aug. 22, 2001.

U.S. patent application Ser. No. 09/928,755, Uytterhoeven et al., filed Aug. 13, 2001.

* cited by examiner

*Primary Examiner*—Thorl Chea
(74) *Attorney, Agent, or Firm*—Leydig, Voit & Mayer, Ltd.

(57) ABSTRACT

A process for preparing monosheet black and white photothermographic recording material, the photothermographic recording material being exclusive of a dye-providing compound and comprising a support and a photo-addressable thermally developable element, the photo-addressable thermally developable element being thermally developable under substantially water-free conditions and consisting of one or more layers, the layers together comprising photosensitive silver halide, a substantially light-insensitive organic silver salt, a reducing agent therefor in thermal working relationship therewith and a binder, comprising the steps of: (i) coating at least one of the one or more layers of the photo-addressable thermally developable from an aqueous medium; (ii) drying the layer or layers coated in step (i); and (iii) heating the photothermographic recording material at a temperature of at least 35° C. in the dark for a period of at least 3 days; and a photothermographic recording material obtainable therewith.

8 Claims, No Drawings

PHOTOTHERMOGRAPHIC RECORDING MATERIALS WITH IMPROVED STABILITY

The application claims the benefit of U.S. Provisional Application No. 60/243,990 filed Oct. 27, 2000.

FIELD OF THE INVENTION

The present invention relates to a process for preparing photothermographic recording materials with an improved stability.

BACKGROUND OF THE INVENTION

U.S. Pat. No. 3,152,904 discloses an image reproduction sheet which comprises a radiation-sensitive heavy metal salt which can be reduced to free metal by a radiation wave length between an X-ray wave length and a five microns wave length and being distributed substantially uniformly laterally over the sheet, and as the image forming component an oxidation-reduction reaction combination which is substantially latent under ambient conditions and which can be initiated into reaction by the free metal to produce a visible change in colour comprising an organic silver salt containing carbon atoms and different from the heavy metal salt as an oxidizing agent and in addition an organic reducing agent containing carbon atoms, the radiation-sensitive heavy metal salt being present in an amount between about 50 and about 1000 parts per million of the oxidation-reduction reaction combination.

EP-A 386 761 discloses a heat developable color photographic material comprising a support having thereon at least a photosensitive silver halide, a binder, and a dye providing compound capable of releasing or forming a diffusible dye in correspondence or counter correspondence to reduction of the silver halide to silver, said heat developable color photosensitive material further comprising a compound represented by formula (I): $C_{6n}(H_2O)_{5n+1}$ wherein n represents an integer of 1 or more.

There is a constant demand for new ways of stabilizing photothermographic recording materials.

ASPECTS OF THE INVENTION

It is an aspect of the instant invention to provide a photothermographic material with improved background density stability.

It is a further aspect of the instant invention to provide a photothermographic material with an improved stability of the photosensitivity.

Further aspects and advantages of the invention will become apparent from the description hereinafter.

SUMMARY OF THE INVENTION

Surprisingly, it has been found that by subjecting photothermographic recording materials with at least one layer of the one or more layers of the photo-addressable thermally developable element coated from an aqueous medium to temperatures at or above 35° C. in the dark for at least 3 days, there is little or no change in background density Dmin and moreover that the Dmin had been stabilized, as evidenced by the little or no additional change in Dmin upon storage in the dark under conditions such as 7 days at 45° C. and 70% relative humidity, which simulate prolonged shelf-life conditions, whether the photothermographic recording material was present as a roll of material or as individual sheets, whereas with conventional photothermographic recording materials with a photo-addressable thermally developable element coated from solvent a loss of image density is obtained under such conditions.

The above-mentioned aspects of the invention are realized by providing a process for preparing a monosheet black and white photothermographic recording material, the photothermographic recording material being exclusive of a dye-providing compound and comprising a support and a photo-addressable thermally developable element, the photo-addressable thermally developable element being thermally developable under substantially water-free conditions and consisting of one or more layers, the layers together comprising photosensitive silver halide, a substantially light-insensitive organic silver salt, a reducing agent therefor in thermal working relationship therewith and a binder, comprising the steps of: (i) coating at least one of the one or more layers of the photo-addressable thermally developable from an aqueous medium; (ii) drying the layer or layers coated in step (i); and (iii) heating the photothermographic recording material at a temperature of at least 35° C. in the dark for a period of at least 3 days.

A photothermographic recording material is also provided by the present invention obtainable by the above-mentioned process.

Further preferred embodiments of the present invention are disclosed in the dependent claims.

DETAILED DESCRIPTION OF THE INVENTION

Definitions

The term aqueous for the purposes of the present invention means containing at least 60% by volume of water, preferably at least 80% by volume of water, and optionally containing water-miscible organic solvents such as alcohols e.g. methanol, ethanol, 2-propanol, butanol, iso-amyl alcohol, octanol, cetyl alcohol etc.; glycols e.g. ethylene glycol; glycerine; N-methyl pyrrolidone; methoxypropanol; and ketones e.g. 2-propanone and 2-butanone etc.

Substantially light-insensitive means not intentionally light sensitive and resistant to darkening upon exposure.

A monosheet photothermographic recording material is a photothermographic recording material in which all the ingredients for image formation are present in a single sheet and the image formation occurs in that sheet without the assistance of one or more additional sheets.

A black and white and white photothermographic recording material is a photothermographic recording material with which substantially neutral black images are produced.

Exclusive of a dye providing compound means that dyes providing compounds capable of releasing or forming a diffusible or non-diffusible dye are not present The UAg of an aqueous liquid is defined in this specification as the potential difference between a silver electrode (of 99.99% purity) in the aqueous liquid and a reference electrode consisting of a Ag/AgCl-electrode in 3M KCl solution at room temperature connected with the liquid via a salt bridge consisting of a 10% $KNO_3$ salt solution.

S is defined as that exposure in $mJ/m^2$ at which the photothermographic recording material attained an optical density of 1.0 above Dmin. Thus the lower the value of S, the higher the photosensitivity of the photothermographic recording material.

By the term "heat solvent" in this specification is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the first silver salt, at a temperature above 60° C.

By thermally developable under substantially water-free conditions as used is the present specification, means heating at a temperature of 80° to 250° C. under conditions in which the reaction system is approximately in equilibrium with water in the air, and water for inducing or promoting the reaction is not particularly or positively supplied from the exterior of the thermographic recording material. Such a condition is described in T. H. James, "The Theory of the Photographic Process, Fourth Edition, Macmillan 1977", page 374.

Process for Preparing a Photothermographic Recording Material

A process for preparing a photothermographic recording material, the photothermographic recording material comprising a support and a photo-addressable thermally developable element, the photo-addressable thermally developable element consisting of one or more layers, the layers together comprising photosensitive silver halide, a substantially light-insensitive organic silver salt, a reducing agent therefor in thermal working relationship therewith and a binder, comprising the steps of: (i) coating at least one of the one or more layers of the photo-addressable thermally developable element from an aqueous medium; (ii) drying the layer or layers coated in step (i); and (iii) heating the photothermographic recording material at a temperature of at least 35° C. in the dark for a period of at least 3 days. The temperature is preferably at least 40° C. and particularly preferably at least 45° C. Furthermore, the temperature is preferably less than 50° C.

The period is preferably at least 1 week and the heating is preferably carried out at a relative humidity between 10 and 75% and particularly preferably between 15 and 70%. Especially preferred is heating in the dark for 7 days at 45° C. and 70% relative humidity.

One of the layers coated in step (i) is preferably coated from an aqueous dispersion comprising a first silver salt, a photosensitive silver halide, a second silver salt and a binder, wherein the aqueous dispersion is substantially free of a water-soluble metal or ammonium salt of an aliphatic carboxylic acid, the first silver salt is a substantially light-insensitive and substantially water-insoluble silver salt of an organic carboxylic acid, and the second silver salt has a solubility in water at 20° C. greater than 0.1 g/L. Such treatment surprisingly resulted in photothermographic materials whose Dmin and S-values were both stabilized by the heat treatment according to the present invention, whereas without the addition of the water-soluble silver salt to the aqueous dispersion only Dmin stabilization was observed as a result of the heat treatment according to the present invention.

Photosensitive Silver Halide

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium or iridium etc., or a combination thereof. The details of these procedures are described in T. H. James, "The Theory of the Photographic Process", Fourth Edition, Macmillan Publishing Co. Inc., New York (1977), Chapter 5, pages 149 to 169.

The grain size of the silver halide particles can be determined by the Moeller Teller method in the sample containing silver halide particles is sedimented upon a filter paper, which is submerged in electrolyte together with a negative platinum needle-shaped electrode and a reference electrode. The silver halide particles on the filter paper are slowly scanned individually with the needle-shaped electrode, whereupon the silver halide grains are individually electrochemically reduced at the cathode. This electrochemical reduction is accompanied by a current pulse, which is registered as a function of time and integrated to give the charge transfer Q for the electrochemical reduction of the silver halide particle, which is proportional to its volume. From their volume the equivalent circular grain diameter of each grain can be determined and therefrom the average particle size and size distribution.

The photosensitive silver halide used in the present invention may be employed in a range of 0.1 to 100 mol percent; preferably, from 0.2 to 80 mol percent; particularly preferably from 0.3 to 50 mol percent; especially preferably from 0.5 to 35 mol %; and especially from 1 to 12 mol % of substantially light-insensitive organic silver salt.

An aqueous dispersion comprising photosensitive silver halide can be produced using conventional dispersion techniques such as described in Chapter III of "The Theory of the Photographic Process Fourth Edition, Ed. T. H. James, Eastman Kodak (1977)".

Aqueous Dispersion Comprising a Substantially Light-insensitive Organic Silver Salt Research Disclosure number 17029, published in June 1978, in section II gives a survey of different methods of preparing organic silver salts. In order to obtain a fine dispersion of an organic silver salt, either the synthesis has to be carried out in an organic solvent medium as disclosed, for example, in U.S. Pat. No. 3,700,458 or in a mixture of water and a substantially water insoluble organic solvent as disclosed, e.g., in U.S. Pat. No. 3,960,908 for silver carboxylates.

An aqueous dispersion comprising substantially light-insensitive silver salts of an organic carboxylic acid, can be prepared by any conventional dispersion technique, for example ball milling, microfluidization, pearl mills etc. together with anionic surfactants, non-ionic surfactants and/or dispersion agents. Alternatively the aqueous dispersion comprising a substantially light-insensitive organic silver salt can be produced directly such as disclosed in EP-A 848 286 and EP-A 754 969.

Water-soluble Silver Salt

The water-soluble silver salt in the aqueous dispersion of a preferred embodiment of the present invention has a solubility in water at 20° C. of greater than 0.1 g/L, with greater than 1 g/L being preferred.

Suitable water-soluble silver salts include silver nitrate, silver acetate, silver propionate, silver sulfate, silver butyrate, silver isobutyrate, silver benzoate, silver tartrate, silver salicylate, silver malonate, silver succinate and silver lactate, with water-soluble silver salts selected from the group consisting of silver nitrate, silver acetate, silver lactate and silver sulfate being preferred.

It is known in silver halide photography that addition of soluble silver salts to a dispersion of a silver halide produces an increase in UAg (=decrease in pAg=an increase in free silver ion concentration), which can result in partial reduction of the silver salts present, thereby producing metallic silver nuclei. Such metallic silver nuclei give rise to an increased fogging level in silver halide photographic materials. It is possible that an analogous effect is the basis for the sensitivity increase arising from the present invention.

Processes for Preparation of an Aqueous Dispersion Comprising Photosensitive Silver Halide and a Substantially Light-insensitive Organic Silver Salt Aqueous dispersion comprising photosensitive silver halide and a substantially light-insensitive organic silver salt can incorporate so-called in-situ silver halide, prepared by conversion of a light-insensitive organic silver salt with a halide ion source such as described in U.S. Pat. No. 3,457,075 and WO 97/48104, so-called ex-situ silver halide in which ex-situ silver halide is either mixed with particles of substantially light-insensitive organic silver salt or is present during the preparation of the particles of substantially light-insensitive organic silver salt as disclosed in U.S. Pat. No. 3,839,049 or by a mixture of in-situ and ex-situ produced silver halide as disclosed in EP-A 922 995.

Photo-addressable Thermally Developable Element

According to the present invention the photo-addressable thermally developable element is prepared by coating one or more layers with at least one layer being coated from an aqueous medium. The photo-addressable thermally developable element comprises photosensitive silver halide, a substantially light-insensitive organic silver salt, a reducing agent therefor in thermally working relationship therewith, a binder and optionally other ingredients such as spectral sensitizers, supersensitizers, toning agents and stabilizers which assist in the image-forming process or in the stabilization of the resulting image. The element may comprise a layer system with the silver halide in catalytic association with the substantially light-insensitive silver salt of an organic carboxylic acid, spectral sensitizer optionally together with a supersensitizer in intimate sensitizing association with the silver halide particles and the other ingredients active in the thermal development process or pre- or post-development stabilization of the element being in the same layer or in other layers with the proviso that the organic reducing agent and the toning agent, if present, are in thermal working relationship with the substantially light-insensitive silver salt of an organic carboxylic acid i.e. during the thermal development process the reduce agent and the toning agent, if present, are able to diffuse to substantially light-insensitive silver salt of an organic carboxylic acid. The thickness of the thermosensitive element is preferably in the range of 1 to 50 $\mu$m.

The photo-addressable thermally developable element may also be coated with a protective layer.

Substantially Light-insensitive Silver Salt of an Organic Carboxylic Acid

Preferred substantially light-insensitive silver salts of an organic carboxylic acid are those having as their organic group: aryl, aralkyl, alkaryl or alkyl. Aliphatic carboxylic acids known as fatty acids, wherein the aliphatic carbon chain has preferably at least 12 C-atoms, are particularly preferred e.g. silver laurate, silver palmitate, silver stearate, silver hydroxystearate, silver oleate, silver behenate and silver arichidate, which silver salts are also called "silver soaps". Silver salts of modified aliphatic carboxylic acids with thioether group, as described e.g. in GB-P 1,111,492, and silver salts of carboxylic acids described in Research Disclosure 17029, but excluding silver salts of organic carboxylic acids substituted with a heterocyclic thione group as disclosed in Research Disclosure 12542 and U.S. Pat. No. 3,785,830, may likewise be used to produce a thermally developable silver image.

The term substantially light-insensitive silver salt of an organic carboxylic acid also includes mixtures of different silver salts of organic carboxylic acids.

Organic Reducing Agents

Suitable organic reducing agents for the reduction of light-insensitive organic silver salts are organic compounds containing at least one active hydrogen atom linked to O, N or C, such as is the case with: aromatic di- and tri-hydroxy compounds; aminophenols; METOL™; p-phenylenediamines; alkoxynaphthols, e.g. 4-methoxy-1-naphthol described in U.S. Pat. No. 3,094,41; pyrazolidin-3-one type reducing agents, e.g. PHENIDONE™; pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378. Particularly suitable reducing agents are sterically hindered phenols, bisphenols, sulfonamidophenols and those described in WO97/04357.

Combinations of reducing agents may also be used that on heating become reactive partners in the reduction of the substantially light-insensitive silver salt of an organic carboxylic acid. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. Nos. 5,545,505, 5,545,507 and 5,558,983; acrylonitrile compounds as disclosed in U.S. Pat. Nos. 5,545,515 and 5,635,339; and 2-substituted malonodialdehyde compounds as disclosed in U.S. Pat. No. 5,654,130

Binders for the Photo-addressable Thermally Developable Element

The film-forming binder for use in the photo-addressable thermally developable element of the present invention may be a water-dispersible or a water-soluble binder.

Suitable water-soluble film-forming binders are: polyvinyl alcohol, polyacrylamide, polymethacrylamide, polyacrylic acid, polymethacrylic acid, polyethyleneglycol, polyvinylpyrrolidone, proteinaceous binders such as gelatine, modified gelatines such as phthaloyl gelatine, polysaccharides, such as starch, gum arabic and dextran and water-soluble cellulose derivatives.

Suitable water-dispersible binders are any water-insoluble polymers e.g. water-insoluble cellulose derivatives, polyurethanes, polyesters polycarbonates and polymers derived from $\alpha,\beta$-ethylenically unsaturated compounds such as after-chlorinated polyvinyl chloride, partially hydrolyzed polyvinyl acetate, polyvinyl acetals, preferably polyvinyl butyral, and homopolymers and copolymers produced using monomers selected from the group consisting of: vinyl chloride, vinylidene chloride, acrylonitrile, acrylamides, methacrylamides. methacrylates, acrylates, methacrylic acid, acrylic acid, vinyl esters, styrenes, dienes and alkenes; or mixtures thereof.

Preferred water-dispersible binders are water-dispersible film-forming polymers with covalently bonded ionic groups selected from the group consisting of sulfonate, sulfinate, carboxylate, phosphate, quaternary ammonium, tertiary sulfonium and quaternary phosphonium groups. Further preferred water-dispersible binders are water-dispersible film-forming polymers with covalently bonded moieties with one or more acid groups.

It should be noted that there is no clear cut transition between a polymer dispersion and a polymer solution in the case of very small polymer particles resulting in the smallest particles of the polymer being dissolved and those slightly larger being in dispersion.

Water-dispersible binders with crosslinkable groups, e.g. epoxy groups, aceto-acetoxy groups and crosslinkable double bonds are also preferred. Preferred water-dispersible binders for use in the photo-addressable thermally developable element of the present invention are polymer latexes as disclosed in WO 97/04355.

The above mentioned binders or mixtures thereof may be used in conjunction with waxes or "heat solvents" also called "thermal solvents" or "thermosolvents" improving the reaction speed of the redox-reaction at elevated temperature.

Spectral Sensitizer

The photo-addressable thermally developable element of the photothermographic recording material according to the present invention may contain a spectral sensitizer, optionally together with a supersensitizer, for the silver halide appropriate for the wavelength of the light source which may in the near UV, visible, e.g. 630 nm, 670 nm etc., or IR, parts of spectrum. The silver halide may be spectrally sensitized with various known dyes including cyanine, merocyanine, styryl, hemicyanine, oxonol, hemioxonol and xanthene dyes optionally, particularly in the case of sensitization to infra-red radiation, in the presence of a so-called supersensitizer. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective.

Supersensitizers

According to the present invention the photo-addressable thermally developable element may further include a supersensitizer. Preferred supersensitizers are selected from the group of compounds consisting of: mercapto-compounds, disulfide-compounds, stilbene compounds, organoborate compounds and styryl compounds.

Toning Agents

In order to obtain a neutral black image tone in the higher densities and neutral grey in the lower densities, the photo-addressable thermally developable element according to the present invention may contain one or more toning agents. The toning agents should be in thermal working relationship with the substantially light-insensitive organic silver salt and reducing agent therefor during thermal processing.

Stabilizers and Antifoggants

In order to obtain further improvement in shelf-life and background density level, stabilizers and antifoggants may be incorporated into the photo-addressable thermally developable element of the present invention.

Support

The support for the photothermographic recording material and aqueous dispersions according to the present invention may be transparent, translucent or opaque and is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. The support may be in sheet, ribbon or web form. The support may be subbed with a subbing layer. It may also be made of an opacified resin composition.

Antihalation Dyes

The photothermographic recording materials used in the present invention may also contain antihalation or acutance dyes which absorb light which has passed through the photosensitive thermally developable photographic material, thereby preventing its reflection. Such dyes may be incorporated into the photo-addressable thermally developable element or in any other layer of the photothermographic material of the present invention.

Antistatic Layer

In a preferred embodiment the photothermographic recording material of the present invention an antistatic layer is applied to an outermost layer.

Surfactants and Dispersants

Surfactants are surface active agents which are soluble compounds which reduce the interfacial tension between a liquid and a solid. The aqueous dispersions of the present invention may contain anionic, non-ionic or amphoteric surfactants, with anionic and non-ionic surfactants preferred as disclosed in WO 97/04356 herein incorporated by reference. Suitable dispersants are natural polymeric substances, synthetic polymeric substances and finely divided powders, for example finely divided non-metallic inorganic powders such as silica.

Coating

The coating of any layer of the aqueous dispersions of the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA.

Photothermographic Printing

Photothermographic recording materials, according to the present invention, may be exposed with radiation of wavelength between an X-ray wavelength and a 5 microns wavelength with the image either being obtained by pixelwise exposure with a finely focused light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the object itself or an image therefrom with appropriate illumination e.g. with UV, visible or IR light.

For the thermal development of image-wise exposed photothermographic recording materials, according to the present invention, any sort of heat source can be used that enables the recording materials to be uniformly heated to the development temperature in a time acceptable for the application concerned e.g. contact heating, radiative heating, microwave heating etc.

INDUSTRIAL APPLICATION

Photothermographic recording materials according to the resent invention may be used for both the production of transparencies, for example in the medical diagnostic field in which black-imaged transparencies are widely used in inspection techniques operating with a light box, reflection type prints, for example in the hard copy graphics field and in microfilm applications. For such applications the support will be transparent or opaque, i.e. having a white light reflecting aspect. Should a transparent base be used, the base may be colourless or coloured, e.g. with a blue colour for medical diagnostic applications.

The invention is described hereinafter by way of INVENTION EXAMPLES 1 to 17 and COMPARATIVE EXAMPLES 1 to 6 in which all percentages are percentages by weight unless otherwise specified and the following ingredients were used:

AgB = silver behenate

SENSI 01 =

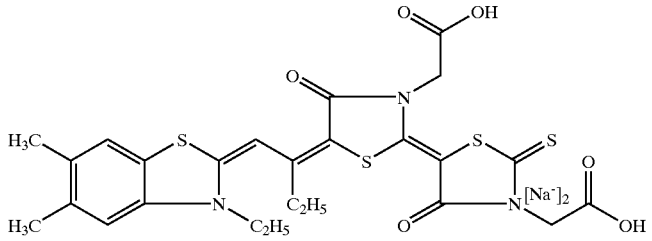

LOWINOX 22IB46 = 2-propyl-bis(2-hydroxy-3,5-dimethylphenyl)methane from CHEM. WERKE LOWI;

R16875 = type R16875, a phthaloyl gelatine from ROUSSELOT;

K7598 = Type 7598, a calcium-free gelatin from AGFA-GEVAERT GELATINEFABRIEK;

Surfactant Nr. 1 = MARLON ™ A-396, a sodium alkyl-phenylsulfonate from Hüls;

Surfactant Nr. 2 = ERKANTOL ™ BX, a sodium diisopropyl-naphthalenesulfonate from BAYER;

Surfactant Nr. 3 = ULTRAVON ™ W, supplied as a 75–85% concentrate of a sodium arylsulfonate by CIBA-GEIGY;

TA01 = phthalazine;

STABI 01 =

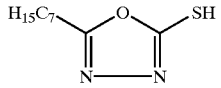

STABI 02 = 4-methyl-phthalic acid; and

STABI 03 = phenyl tribromomethyl sulfone.

antihalation layer:

ANTIHALO 01

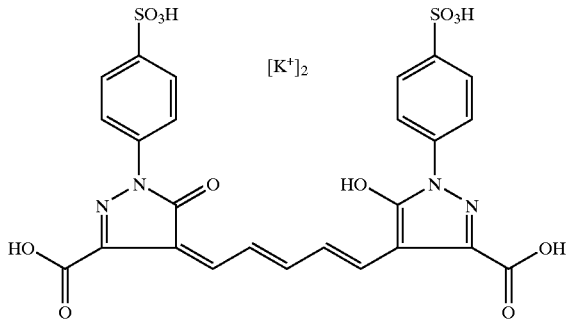

-continued

| | | |
|---|---|---|
| K7598 | = | Type 7598, a calcium-free gelatin from AGFA-GEVAERT GELATINEFABRIEK; |
| KIESELSOL 300F | = | a 30% aqueous dispersion of colloidal silica from BAYER; and |
| LATEX 01 | = | a poly(ethyl acrylate) latex. |
| protective layer: | | |
| K7598 | = | Type 7598, a calcium-free gelatin from AGFA-GEVAERT GELATINEFABRIEK vorm. KOEPFF & SÖHNE; |
| Surfactant Nr. 4 | = | ammonium salt of perfluoro-octanoic acid. |

Preparation of Photosensitive Silver Halides

Two silver halide emulsions were used in the INVENTION and COMPARATIVE EXAMPLES of the present invention, with compositions summarized in Table 1:

TABLE 1

| | AgX-composition | | | grain size | preparation |
|---|---|---|---|---|---|
| Type | at % Br | at % I | dopant(s) | [nm] | temperature [° C.] |
| 01 | 100 | 0 | — | 73 | 50.5 |
| 02 | 97 | 3 | $Ir^{4+}$ | 68 | 50 |

Type 01 silver halide consisting of 11.44% by weight of 100 mol % silver bromide, with a weight average particle size of 73 nm as measured with the Moeller Teller method (see above for details), and 5.17% by weight of R16875 as dispersing agent in deionized water was prepared at 50.5° C. using conventional silver halide preparation techniques such as described, for example, in T. H. James, "The Theory of the Photographic Process", Fourth Edition, Macmillan Publishing Co. Inc., New York (1977), Chapter 3, pages 88–104.

Type 02 silver halide was produced as for Type 01 except that it contains 3 mol % of silver iodide; it was prepared at 50° C. rather than 50.5° C.; and a solution of 1 g/L of $K_2IrCl_6$. $6H_2O$ was additionally added once 90% of the silver nitrate had been added such than the AgX obtained contained $2.10^{-5}$ mol $Ir^{4+}$/mol AgX.

INVENTION EXAMPLES 1 TO 7

Comparative Examples 1 to 3

Preparation of Silver Behenate Dispersions in an Aqueous Medium Using a Single Jet Process The aqueous dispersion of silver behenate used in INVENTION EXAMPLES 1 to 7 and COMPARATIVE EXAMPLES 1 to 3 was produced as follows:

i) dispersing 136.2 g (0.4M) behenic acid with stirring at 310 rpm with a 80 mm diameter typhoon stirrer in a 200 mm diameter vessel at 80° C. in a quantity of 549 mL of a 10% solution of Surfactant nr 1 and 662 g of deionized water at a temperature of 80° C.;

ii) then adding 188 mL of a 2M aqueous solution of sodium hydroxide with stirring at 310 rpm with a 80 mm diameter typhoon stirrer to the 200 mm in diameter vessel at 80° C. over a period of 10 minutes to produce a clear solution substantially containing sodium behenate;

iii) then adding a 360 mL of a 1M aqueous solution of silver nitrate with stirring at 310 rpm with a 80 mm diameter typhoon stirrer to the 200 mm in diameter vessel at a temperature of 80° C. over a period of 4.5 minutes to convert the sodium behenate completely into silver behenate.

The aqueous silver behenate dispersion obtained contained 8.15% by weight of silver behenate and 2.78% by weight of Surfactant 1 and was subsequently desalted and concentrated using ultrafiltration to an aqueous dispersion containing 22.37% by weight of silver behenate.

Preparation of Aqueous Dispersion Comprising Photosensitive Silver Halide and a Substantially Light-insensitive Organic Silver Salt 26.2 g of K7598 was dissolved in 150 g of deionized water at 40° C. To this gelatin solution 19.35 g of a 11.44% by weight dispersion of the particular silver halide used was then added over a period of 20 s with stirring corresponding to 11.7 mmol of silver halide, the quantity of silver nitrate given in Table 2 for the particular EXAMPLE was then added as a 3.56% by weight aqueous solution and the resulting dispersion made up to 265.4 g with demineralized water while maintaining the temperature at 40° C. After stirring for 1 hour at 40° C. a UAg measurement was carried out (UAg-1) then 206.6 g of the above-described silver behenate dispersion was added together with 2.4 g of 1N nitric acid and after a further 20 minutes stirring at 40° C. a second UAg measurement (UAg-2) was carried out.

After the second UAg measurement the following ingredients were added: 8.7 g of a 4 g/L solution of SENSI 01 followed by 20 minutes stirring, then 11.8 g of a 8% by weight solution in methanol of STABI 01 and finally just before coating 112 g of a dispersion consisting of 4.68% by weight of phthalazine, 16.84% by weight of LOWINOX 22IB46 and 2% by weight of Surfactant Nr. 2.

Preparation of the Photothermographic Recording Materials

A antihalation layer dispersion was prepared by dissolving 62.5 g of K7598 in 1L of deionized water at 40° C. The following ingredients were then added to the resulting gelatin solution: 14.5 g of a 10% by weight aqueous solution of ANTIHALO 01, 8 g of a 10% by weight aqueous dispersion of LATEX 01, 42 g of a 20% by weight aqueous dispersion of KIESELSOL 300F and finally the pH was adjusted to 6 before coating to a wet-layer thickness of 45 μm on one side of a 100 μm poly(ethylene terephthalate) support subbed on both sides and drying at 25° C. for 5 minutes.

A solution for the first layer of the photo-addressable thermally developable element was then prepared by dissolving 42.5 g of K7598 in 1928.2 g of deionized water at 40° C. and then adding the following ingredients with stirring: 8.7 g of STABI 02, 179.1 g of a STABI 03-dispersion (consisting of 17.5% by weight of STABI 03, 10% by weight of K7598 and 1% by weight of Surfactant Nr. 1), 6 g of 1-phenyl-5-mercapto-tetrazole dissolved in 227.3 g of methanol and 17.4 g of a 10% solution of Surfactant Nr. 3.

The side of the support not coated with the antihalation layer was then coated with the solution for the first layer of the thermosensitive element to a wet layer thickness of 50 μm to produce after drying at 25° C. for 5 minutes the first layer of the thermosensitive element.

The first layer of the thermosensitive element was then overcoated with the above-described aqueous dispersion to a wet layer thickness of 100 μm to form after drying at 25° C. for 5 minutes the second layer of the thermosensitive element.

Finally the second layer of the thermosensitive element was overcoated with a solution of 57 g of K7598 in 2560 g of deionized water to which 78 g of a 5% by weight solution of Surfactant Nr. 4 had been added to a wet layer thickness of 50 μm to form after drying at 25° C. for 5 minutes a protective layer.

The photothermographic recording materials of COMPARATIVE EXAMPLE 1 and INVENTION EXAMPLES 1 to 3 were prepared by subjecting a freshly coated photothermographic recording material A to ageing regimes outside and within the scope of the present invention and those of COMPARATIVE EXAMPLES 2 and 3 and INVENTION EXAMPLES 4 to 7 were prepared by subjecting a freshly coated photothermographic recording material B to different ageing regimes outside and within the scope of the present invention. Details regarding the preparation of the fresh photothermographic recording materials A and B are given in Table 2.

Ageing regimes (Ci) and (Cii):

Ci) 1 week in the dark at 20° C. at ca. 45% relative humidity;

Cii) 6 weeks in the dark at 20° C. at ca. 45% relative humidity;

lay outside the scope of the present invention and served to delineate ageing regimes which resulted in stabilization of the photothermographic performance of photothermographic recording materials from those that did not. Ageing regimes (i) to (x) are according to the present invention:

i) 1 week in the dark at 35° C. at ca. 45% relative humidity*;

ii) 1 week in the dark at 40° C. at ca. 45% relative humidity*;

iii) 1 week in the dark at 43° C. at ca. 45% relative humidity*;

iv) 1 week in the dark at 45° C. at ca. 15% relative humidity*;

v) 1 week in the dark at 45° C. and 70% relative humidity;

vi) 1 week in the dark at 45° C. and 70% relative humidity followed by 1 week in the dark at 20° C. at ca. 45% relative humidity;

vii) 1 week in the dark at 45° C. and 70% relative humidity followed by 5 weeks in the dark at 20° C. at ca. 45% relative humidity;

viii) 1 week in the dark at 45° C. and 70% relative humidity followed by 1 week in the dark at 35° C. and 80% relative humidity;

ix) 2 weeks in the dark at 45° C. and 70% relative humidity;

x) 1 week in the dark at 47° C. at ca. 45% relative humidity;

* forced air drying cupboard, relative humidity given is the atmospheric relative humidity during the ageing test

Evaluation of the Photothermographic Recording Materials

The photothermographic recording materials of INVENTIVE EXAMPLES 1 to 7 and COMPARATIVE EXAMPLES 1 to 3 were first exposed to a He—Ne laser (632.8 nm) through a grey scale wedge to vary the exposure of the film and then heated for 20 s at 100° C. to produce a wedge image and Dmin was determined with a MACBETH TD903 densitometer with a visual filter giving the dependence of optical density upon exposure. The S-values, defined as the exposure in mJ/m$^2$ at which an optical density of 1.0 above Dmin was achieved, were determined from these optical density-exposure dependencies. The lower the value of exposure, S, required to obtain an optical density of 1.0 above Dmin, the higher the photosensitivity of the photothermographic material.

Photothermographic evaluation was carried out on freshly coated photothermographic recording materials and also after being subjected to the above-mentioned ageing regimes to determine the changes in background density ΔDmin and in S, ΔS.

The Dmin and S-values for the fresh photothermographic recording materials A and B are given Table 2.

TABLE 2

| Fresh photothermographic recording material | AgX-type | moles $AgNO_3$ added | mol second silver salt/mol AgX | U0Ag-1 [mV] | UAg-2 [mV] | fresh material Dmin | fresh material S [mJ/m$^2$] |
|---|---|---|---|---|---|---|---|
| A | 02 | 0 | 0 | 124 | 273 | 0.37 | 631 |
| B | 02 | $4.19 \times 10^{-3}$ | 0.358 | 447 | 423 | 0.34 | 178 |

The ΔDmin and ΔS-values after the different ageing regimes with respect to the Dmin- and S-values of the fresh photothermographic recording materials are given in Table 3: COMPARATIVE EXAMPLE 1 and INVENTION EXAMPLES 1 to 3 for fresh material A and COMPARATIVE EXAMPLES 2 and 3 and INVENTION EXAMPLES 4 to 7 for fresh material B.

TABLE 3

| Example Nr | Fresh photo-thermographic recording material | Ageing regime nr. | temp [° C.] | Period [d] | RH [%] | after ageing in dark ΔDmin | ΔS [mJ/m²] |
|---|---|---|---|---|---|---|---|
| Comp. 1 | A | Ci) | 20 | 7 | ca. 45 | +0.26 | +260 |
| Inv. 1 | A | v) | 45 | 7 | 70 | −0.07 | +260 |
| Inv. 2 | A | vi) | 45/20 | 7/7 | 70/45 | −0.07 | +77 |
| Inv. 3 | A | ix) | 45 | 14 | 70 | −0.04 | 0 |
| Comp. 2 | B | Ci) | 20 | 7 | ca. 45 | +0.42 | +46 |
| Comp. 3 | B | Cii) | 20 | 42 | ca. 45 | +1.17 | >+1000 |
| Inv. 4 | B | v) | 45 | 7 | 70 | −0.05 | +46 |
| Inv. 5 | B | vi) | 45/20 | 7/7 | 70/45 | −0.05 | +46 |
| Inv. 6 | B | vii) | 45/20 | 7/35 | 70/45 | −0.03 | +22 |
| Inv. 7 | B | ix) | 45 | 14 | 70 | −0.05 | +22 |

Comparison of the ΔDmin and ΔS-values for the photothermographic recording material of COMPARATIVE EXAMPLE 1 having been subjected to ageing regime Ci), which is outside the present invention, with those for the photothermographic recording materials of INVENTION EXAMPLES 1 to 3, which had been subjected to ageing regimes v), vi) and ix) according to the instant invention, showed a considerable increase in Dmin after subjection of fresh photothermographic recording material A to ageing regime Ci), whereas ageing regimes v), vi) and ix) resulted in virtually no change in Dmin. Furthermore, the first 7 days ageing of ageing regimes vi) and ix) corresponded to ageing regime v), this being followed by an additional 7 days in the dark at 20° C. and 45% relative-humidity for ageing regime vi) and 7 days in the dark at 45° C. and 70% relative humidity for ageing regime ix) respectively. In neither case was a significant further variation in Dmin observed, despite the latter test representing a simulation of prolonged shelf-life. This indicated stabilization of Dmin after the initial 7 days heat treatment in the dark at 45° C. and 70% relative humidity.

COMPARATIVE EXAMPLES 2 and 3 and INVENTION EXAMPLES 4 to 7 were carried out with photothermographic recording material B, which was produced from an aqueous dispersion of a substantially light-insensitive silver salt of an organic carboxylic acid and photosensitive silver halide to which a water-soluble silver salt had been added. COMPARATIVE EXAMPLES 2 and 3 showed that no stabilization of Dmin was achieved after subjection for 7 days in the dark at 20° C. and 45% relative humidity in ageing test Ci) (COMPARATIVE EXAMPLE 2), despite an increase of 0.42 in Dmin, as evidenced by the further 0.75 increase in Dmin upon a further 35 days in the dark at 20° C. and ca. 45% relative humidity (COMPARATIVE EXAMPLE 3). On the other hand subjection of photothermographic recording material B to 7 days in the dark at 45° C. and 70% relative humidity resulted in a slight decrease in Dmin [see ageing test v) and INVENTION EXAMPLE 4]. Furthermore, the first 7 days ageing of ageing regimes vi), vii) and ix) corresponded to ageing regime v), this being followed by an additional 7 days in the dark at 20° C. and 45% relative humidity for ageing regime vi), an additional 35 days in the dark at 20° C. and 45% relative humidity for ageing regime vii) and an additional 7 days in the dark at 45° C. and 70% relative humidity for ageing regime ix) respectively (INVENTION EXAMPLES 5, 6 and 7). In none of these cases was a significant further variation in Dmin observed, despite the ageing test ix) representing a simulation of prolonged shelf-life. This again indicated stabilization of Dmin after the initial 7 days heat treatment in the dark at 45° C. and 70% relative humidity.

COMPARATIVE EXAMPLES 4 TO 6 and Invention Examples 8 to 17

The fresh photothermographic recording materials C and D were produced as described above for the fresh recording materials A and B respectively except that type 01 silver halide was used instead of type 02 silver halide. Details regarding the preparation of the fresh photothermographic recording materials C and D are given in Table 4.

Photothermographic evaluation, as described above for COMPARATIVE EXAMPLES 1 to 3 and INVENTION EXAMPLES 1 to 7, was carried out on freshly coated photothermographic recording materials C and D and also after they ware subjected to different ageing regimes to determine the changes in background density ΔDmin and in S, ΔS.

The Dmin and S-values for the fresh photothermographic recording materials C and D are given Table 4.

TABLE 4

| Fresh photo-thermographic recording material | AgX-type | moles $AgNO_3$ Added | mol second silver salt/mol AgX | UAg-1 [mV] | UAg-2 [mV] | fresh material Dmin | S [mJ/m²] |
|---|---|---|---|---|---|---|---|
| C | 01 | 0 | 0 | — | 299 | 0.35 | 446 |
| D | 01 | $4.19 \times 10^{-3}$ | 0.358 | 448 | 407 | 0.33 | 95 |

The ΔDmin and ΔS-values after the different ageing regimes with respect to the Dmin- and S-values of the fresh photothermographic recording materials are given in Table 5: COMPARATIVE EXAMPLE 4 and INVENTION EXAMPLE 8 for fresh material C and COMPARATIVE EXAMPLES 5 and 6 and INVENTION EXAMPLES 9 to 17 for fresh material D.

TABLE 5

| Example nr | Fresh photo-thermographic recording material | Ageing regime nr. | temp [° C.] | Period [d] | RH [%] | after ageing in dark ΔDmin | Δs [mJ/m²] |
|---|---|---|---|---|---|---|---|
| Comp. 4 | C | Ci) | 20 | 7 | 45 | +0.91 | +509 |
| Inv. 8 | C | v) | 45 | 7 | 70 | −0.04 | +116 |
| Comp. 5 | D | Ci) | 20 | 7 | 45 | +0.64 | +46 |
| Comp. 6 | D | Cii) | 20 | 42 | 45 | +1.59 | >+1000 |
| Inv. 9 | D | i) | 35 | 7 | Ca. 45 | +0.05 | +40 |
| Inv. 10 | D | ii) | 40 | 7 | Ca. 45 | +0.04 | +25 |
| Inv. 11 | D | iii) | 43 | 7 | Ca. 45 | +0.04 | +31 |
| Inv. 12 | D | x) | 47 | 7 | Ca. 45 | +0.06 | +40 |
| Inv. 13 | D | iv) | 45 | 7 | 15 | +0.01 | +12 |
| Inv. 14 | D | v) | 45 | 7 | 70 | −0.01 | −2 |
| Inv. 15 | D | vi) | 45/20 | 7/7 | 70/45 | −0.02 | +5 |
| Inv. 16 | D | vii) | 45/20 | 7/35 | 70/45 | +0.07 | −15 |
| Inv. 17 | D | viii) | 45/35 | 7/7 | 70/80 | 0.0 | +5 |

Comparison of the ΔDmin and ΔS-values for the photothermographic recording of material of COMPARATIVE EXAMPLE 4 having been subjected to ageing regime Ci), which is outside the present invention, with that for the photothermographic recording material of INVENTION EXAMPLE 8, which was subjecting to ageing regime v) according to the present invention, showed a considerable increase in Dmin after subjection of fresh photothermographic recording material C to ageing regime Ci), whereas ageing regime v) resulted in virtually no change in Dmin (INVENTION EXAMPLE 8).

COMPARATIVE EXAMPLES 5 and 6 and INVENTION EXAMPLES 9 to 17 were carried out with photothermographic recording material D, which was produced from an aqueous dispersion of a substantially light-insensitive silver salt of an organic carboxylic acid and photosensitive silver halide to which a water-soluble silver salt had been added. COMPARATIVE EXAMPLES 5 and 6 showed that no stabilization of Dmin was achieved after subjection for 7 days in the dark at 20° C. and 45% relative humidity in ageing test Ci) (COMPARATIVE EXAMPLE 5), despite an increase of 0.64 in Dmin, as evidenced by the further 0.95 increase in Dmin upon a further 35 days in the dark at 20° C. and ca. 45% relative humidity (COMPARATIVE EXAMPLE 6). On the other hand subjection of photothermographic recording material D to 7 days in the dark at 45° C. and 70% relative humidity resulted in no significant change in Dmin or the S-value [see ageing test v) and INVENTION EXAMPLE 14]. Furthermore, the first 7 days ageing of ageing regimes vi), vii) and viii) corresponded to ageing regime v), this being followed by an additional 7 days in the dark at 20° C. and 45% relative humidity for ageing regime vi), an additional 35 days in the dark at 20° C. and 45% relative humidity for ageing regime vii) and an additional 7 days in the dark at 35° C. and 80% relative humidity for ageing regime viii) respectively (INVENTION EXAMPLES 15, 16 and 17). In none of these cases was a significant further variation in Dmin or S-value observed, despite the ageing test viii) representing a simulation of prolonged shelf-life. This indicated stabilization of both Dmin and S-values after the initial 7 days heat treatment in the dark at 45° C. and 70% relative humidity.

In INVENTION EXAMPLES 9 to 12 photothermographic recording material D was subjected to ageing tests (i) to (iii) and (x) representing 7 days heating in the dark at ca. 45% relative humidity at temperatures between 35 and 47° C. In all cases no significant variation in Dmin was observed.

In INVENTION EXAMPLES 13 photothermographic recording material D was subjected to ageing test (iv) representing 7 days heating in the dark at 45° C. and 15% relative humidity. Again no significant variation in Dmin was observed.

Having described in detail preferred embodiments of the current invention, it will now be apparent to those skilled in the art that numerous modifications can be made therein without departing from the scope of the invention as defined in the following claims.

We claim:

1. A process for preparing a monosheet black and white photothermographic recording material, said photothermographic recording material being exclusive of a dye-providing compound and comprising a support and a photo-addressable thermally developable element, said photo-addressable thermally developable element being thermally developable under substantially water-free conditions and consisting of one or more layers, said layers together comprising photosensitive silver halide, a substantially light-insensitive organic silver salt, a reducing agent therefor in thermal working relationship therewith and a binder, comprising the steps of: (i) coating at least one of the one or more layers of the photo-addressable thermally developable element from an aqueous medium; (ii) drying said layer or layers coated in step (i); and (iii) heating said photothermographic recording material at a temperature of at least 35° C. in the dark for a period of at least 3 days.

2. Process according to claim 1, wherein said temperature is at least 40° C.

3. Process according to claim 1, wherein said temperature is at least 45° C.

4. Process according to claim 1, wherein said temperature is less than 50° C.

5. Process according to claim 1, wherein said period is at least 1 week.

6. Process according to claim 1, wherein said heating is carried out at a relative humidity between 10 and 75%.

7. Process according to claim 1, wherein said photothermographic recording material is heated for 1 week in the dark at 45° C. and 70% relative humidity.

8. A photothermographic recording material obtained by the process of claim 1.

* * * * *